US008733125B2

(12) United States Patent
Heckt et al.

(10) Patent No.: US 8,733,125 B2
(45) Date of Patent: May 27, 2014

(54) REFRIGERANT ACCUMULATOR FOR MOTOR VEHICLE AIR CONDITIONING UNITS

(75) Inventors: Roman Heckt, Aachen (DE); Marc Graaf, Krefeld (DE); Stephan Koster, Langerwehe (DE)

(73) Assignee: Halla Visteon Climate Control Corporation, Daejeon-Si (KR)

( * ) Notice: Subject to any disclaimer, the term of this patent is extended or adjusted under 35 U.S.C. 154(b) by 1049 days.

(21) Appl. No.: 12/190,791

(22) Filed: Aug. 13, 2008

(65) Prior Publication Data

US 2009/0044563 A1 Feb. 19, 2009

(30) Foreign Application Priority Data

Aug. 17, 2007 (DE) ..... 10 2007 039 753

(51) Int. Cl.
*F25B 43/00* (2006.01)

(52) U.S. Cl.
CPC ..... *F25B 43/006* (2013.01)
USPC ..... 62/512

(58) Field of Classification Search
CPC ..... F25B 43/006; F25B 2400/051; F25B 2400/03
USPC ..... 62/470, 503, 512, 84, 83, 174, 513; 137/859, 846, 844, 843, 528; 303/87; 138/30; 165/163
See application file for complete search history.

(56) References Cited

U.S. PATENT DOCUMENTS

| | | | | | |
|---|---|---|---|---|---|
| 1,793,064 | A * | 2/1931 | Cuthbert | 62/217 |
| 1,815,421 | A * | 7/1931 | Shipley | 62/117 |
| 2,764,997 | A * | 10/1956 | McCuistion | 138/31 |
| 3,131,553 | A * | 5/1964 | Ross | 62/506 |
| 3,412,574 | A * | 11/1968 | Reiter | 62/471 |
| 3,827,255 | A * | 8/1974 | Kish | 62/296 |
| 4,187,695 | A * | 2/1980 | Schumacher | 62/503 |
| 4,217,765 | A * | 8/1980 | Ecker | 62/503 |
| 4,266,405 | A * | 5/1981 | Trask | 62/160 |
| 4,800,737 | A * | 1/1989 | Smith et al. | 62/503 |
| 5,052,193 | A * | 10/1991 | Pettitt et al. | 62/503 |
| 5,249,745 | A * | 10/1993 | Bertolotti | 239/76 |
| 5,425,249 | A * | 6/1995 | Lyman | 62/471 |
| 6,182,698 | B1 * | 2/2001 | Barak | 137/845 |
| 6,298,687 | B1 * | 10/2001 | Dienhart et al. | 62/513 |
| 6,463,757 | B1 * | 10/2002 | Dickson et al. | 62/503 |
| 6,467,300 | B1 * | 10/2002 | Noble, III | 62/472 |
| 6,612,128 | B2 * | 9/2003 | Dickson et al. | 62/471 |
| 2006/0196223 | A1 * | 9/2006 | Dexter et al. | 62/503 |

FOREIGN PATENT DOCUMENTS

| | | | |
|---|---|---|---|
| DE | 102 61 866 | A1 | 7/2003 |
| DE | 10294713 | T5 | 7/2004 |
| DE | 69633622 | T2 | 11/2005 |
| DE | 102004050409 | A1 * | 4/2006 |

* cited by examiner

*Primary Examiner* — Frantz Jules
*Assistant Examiner* — Emmanuel Duke
(74) *Attorney, Agent, or Firm* — Fraser Clemens Martin & Miller LLC; J. Douglas Miller

(57) ABSTRACT

The invention relates to a refrigerant accumulator combined with a heat exchanger for a motor vehicle air conditioning unit. The accumulator includes a collector chamber having a liquid disposed therein and a neighboring flow chamber. The collector chamber includes a valve which selectively permits a flow of the liquid from the collector chamber into the flow chamber.

10 Claims, 6 Drawing Sheets

Figure 1:
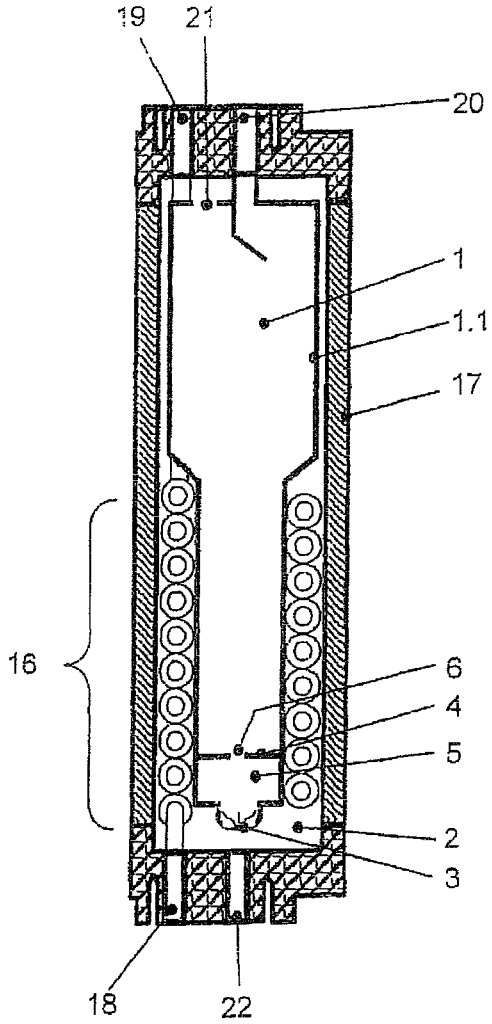

Fig. 8
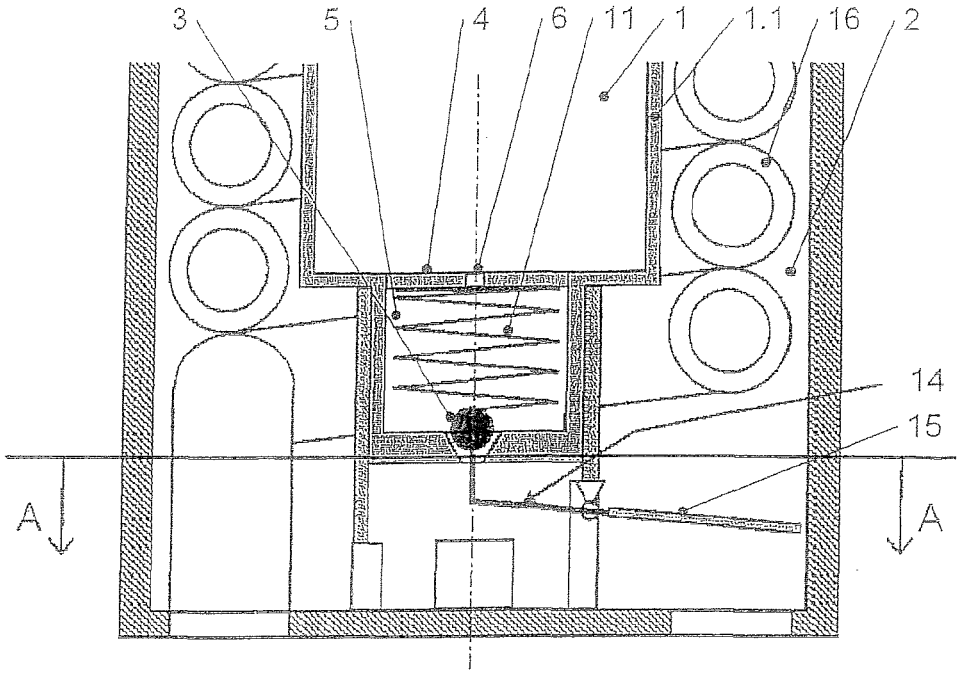
Cross sectional view A-A:
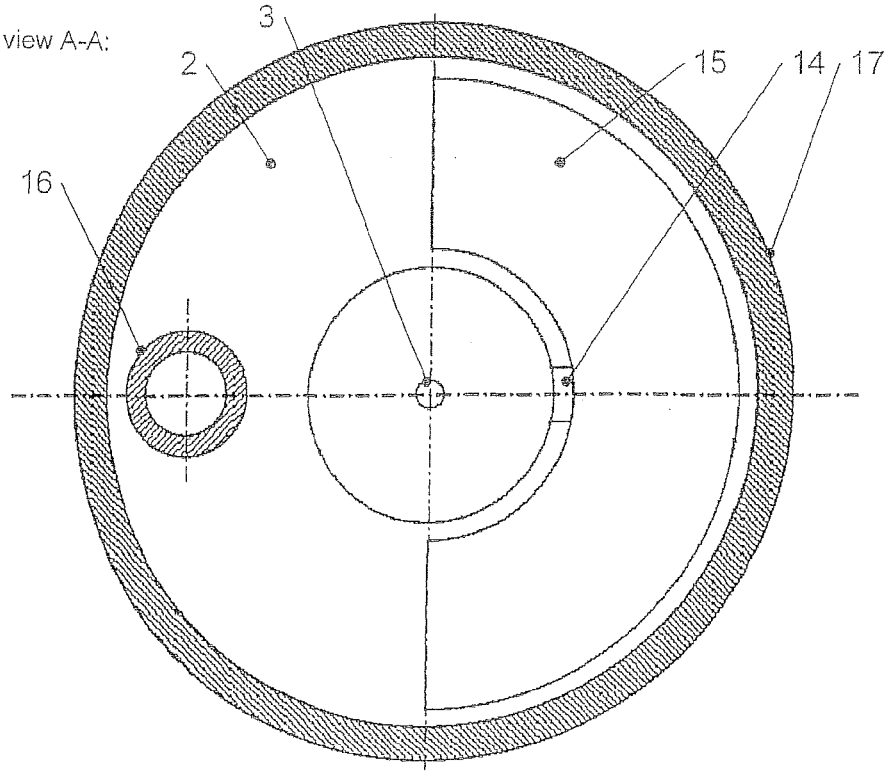
Fig. 9

REFRIGERANT ACCUMULATOR FOR MOTOR VEHICLE AIR CONDITIONING UNITS

CROSS-REFERENCE TO RELATED APPLICATION

This application claims priority to German Patent Application No. 10 2007 039 753.6-13, filed Aug. 17, 2007, the entire disclosure of which is hereby incorporated herein by reference.

FIELD OF THE INVENTION

The invention relates to a refrigerant accumulator for refrigeration and heat pump systems, particularly for use in motor vehicle air conditioning units.

BACKGROUND OF THE INVENTION

Motor vehicle air conditioning units serve to air condition the passenger compartment, frequently including a refrigerant system that functions based on the cold vapor process. The refrigeration systems in mobile applications are mostly provided with a refrigerant accumulator, which may be combined with an internal heat exchanger.

The improvement according to the invention relates to the oil recirculation device of a refrigerant accumulator.

In air conditioning units using the refrigerant R744, an internal heat exchanger is often used to enhance efficiency. The internal heat exchanger functions by supercooling the high-pressure side refrigerant. The internal heat exchanger system-internally transfers heat to the low-pressure side refrigerant, which is thereby superheated.

In vehicle air conditioning units, for reasons of space, the accumulator and the internal heat exchanger are usually combined to form one component.

The combined accumulator with the internal heat exchanger integrates the functions of both single components within one component. The combined component is preferably used in mobile R744-refrigeration systems for the air conditioning of vehicles. The refrigerant accumulator with the internal heat exchanger is disposed, on the low-pressure side, between an evaporator and a compressor and on the high-pressure side, between a gas cooler and an expansion element. In a refrigeration system or a heat pump, the accumulator is positioned downstream of the evaporator, serving to collect varying refrigerant filling quantities due to varying operational conditions and having refrigerant in reserve in order to compensate for leakage losses occurring during the maintenance interval.

Compared to the single components, the combined and, hence, compact component adapts better to the limited space in the engine compartment, also enhancing cost efficiency of the total system.

In most cases, such combined refrigerant accumulators consist of two concentric containers, the inner container serving as accumulator/collector while the internal heat exchanger is positioned in the annular space.

The refrigerant enters the accumulator and is directed through a transfer opening into an annular gap between the inner container and an outer container where the internal heat exchanger is disposed. Typically, the internal heat exchanger is a tube coil heat exchanger having tubes passed by high-pressure fluid. In the space between the tubes, the low-pressure side refrigerant flows. After the low-pressure side refrigerant has left the heat exchanger, it reaches the region of a space between the containers called a flow chamber.

Because an accumulator inevitably also removes recirculating oil from the refrigerant circuit, devices must be created in the accumulator ensuring that the oil is continuously returned to the refrigerant circuit to maintain lubrication of the compressor when the refrigeration system is operated.

From prior art, different designs of refrigerant accumulators, particularly combined with internal heat exchangers, are known.

Oil return from the collector into the refrigerant circuit is established in various ways.

According to DE 102 61 886, a collector and an internal heat exchanger are one component. An inner container functions as the collector having refrigerant in reserve. In an annular gap between the inner and an outer container a tube coil heat exchanger is disposed, which is connected to the high-pressure side of the refrigerant circuit. On the low-pressure side, the refrigerant enters the collector. In the upper range of the collector, an inlet opening of a U-tube is disposed, which leads to the bottom of the collector. There, in the 180°-bend, a little hole is made, through which oil collected in a sump of the accumulator can enter the U-tube. From there, the oil is re-entrained by gaseous refrigerant flow re-entering the system. The U-tube leads upwards entering the heat exchanger.

This solution is particularly disadvantageous due to the space requirements of the U-tube which are at the expense of the collector volume.

From U.S. Pat. No. 6,463,757, a combination component designed coaxial is known, where a collector for oil return designed annular is provided with a small hole in a bottom of the collector. Through the hole the oil can drip from the collector sump into a flow of gaseous refrigerant, which entrains the oil, transporting it to a low-pressure side outlet.

The known refrigerant accumulators are disadvantageous in that in a switched off state of the refrigeration system, refrigerant oil or liquid refrigerant of the collector sump enters the flow channel of the low-pressure side refrigerant in an uncontrolled manner until the liquid level in the accumulator and in the flow channel, or annular space, respectively, have leveled out. During start-up of the refrigeration system, the liquid refrigerant outside the accumulator container must first be evaporated. This causes increased refrigerant mass volume and reduced efficiency for a while. Only after a certain operational time, the refrigerant to be stored will again become completely deposited in the accumulator.

Depending on the liquid level in the flow channel, the danger continues that liquid refrigerant would be entrained to the low-pressure side outlet, thus flowing to the compressor through the suction line. The liquid hammer involved leads, as a rule, to a destroyed or damaged container.

The solutions using a U-tube, on the one hand, to a great extent prevent larger refrigerant quantities from being evaporated quickly, and entering the compressor in liquid state. On the other hand, space requirements of the U-tube are at the expense of the storage volume of the collector. However, because it is required that the necessary storage volume of the accumulator is minimized, particularly for vehicle air conditioning units, this solution is undesirable.

Therefore, the invention is aimed at establishing a refrigerant accumulator that, particularly at a standstill of the compressor, prevents oil and liquid refrigerant from outflowing in an uncontrolled manner from the collector chamber into the flow chamber. At the same time, the useful volume of the collector is to be enlarged or the design volume of the component be made smaller. Also, safe operation of the air conditioning unit is improved by the avoidance of an inflow of large quantities of liquid refrigerant, or oil, into the compressor.

SUMMARY OF THE INVENTION

The problem is solved according to the invention an accumulator container including a valve that opens at a pressure difference between the collector chamber and the flow chamber greater than the hydrostatic pressure of the liquid column in the collector chamber. In this case, refrigerant oil flows from the collector chamber through the valve into the flow chamber.

In switched off state of the refrigeration system, the valve is closed. While in the operational state, the valve is opened based on the flow or pressure conditions resulting from the operational state.

In comparison with solutions provided with a U-tube, the ratio of useful volume to size can be improved as there is no U-tube requiring space. At the same time, the accumulator can be manufactured at a lower cost.

The valve can open its passage either based on a pressure difference between the collector and the flow channel, or on the detection of a flow in the flow channel. Accordingly, the oil or liquid refrigerant from the sump of the collector can only enter the flow channel when the air conditioning unit is operating.

The pressure difference between the flow chamber and the collector chamber results from the pressure loss caused by large friction losses during a flow of the refrigerant gas through the annular space past the internal heat exchanger parts inserted in the annular space.

In an advantageous embodiment of the invention, a flow detector such as a total-head flapper is used. The total-head flapper can detect the refrigerant flow in the flow channel, transferring it into a movement. The movement of the total-head flapper causes the valve to open.

The solution to the problem according to the invention represents a novel refrigerant accumulator that is advantageous compared with prior art. The valve positioned according to the invention at the bottom of the collector closes the oil return of the accumulator when the refrigeration system is switched off, opening when the compressor is operated. When the air conditioning unit is at rest, neither liquid refrigerant nor oil can reach the flow channel, especially at the heat exchanger exit. Thus, heavier refrigerant loads to the compressor while starting the air conditioning unit will be prevented. Corresponding output and efficiency losses of refrigerant accumulators of the prior art can be avoided. Also, likely damages to the compressor due to entry of liquid refrigerant and the water hammer are prevented.

Compared to refrigerant accumulators with U-tubes, the solution according to the invention makes possible to enlarge the useful volume. Alternatively, the size of the accumulator with internal heat exchanger can be reduced to the size required. This gain in space enables a more compact design of the combination component of accumulator and the integrated heat exchanger for mobile R744-refrigerant circuits. This is an outstanding advantage.

A number of suitable valves are available at low cost as standard components, integratable into the collector bottom. Therefore, they can be estimated at lower cost than conventional U-tubes, which additionally enhances cost efficiency.

Finally, the solution according to the invention also gives economic advantages for the manufacture of vehicle air conditioning units.

Further advantageous examples of embodiment of the refrigerant accumulator according to the invention follow from the sub claims.

An advantageous embodiment of the invention includes an intermediate bottom provided with a small oil passage opening disposed above the automatic valve. The intermediate bottom separates a valve chamber from the collector chamber. The valve chamber can only accept a small quantity of oil. Therefore, in the start state of the air conditioning unit, only a small quantity of oil from the valve chamber can enter the flow channel through the valve. Through the narrow opening, the oil, or liquid refrigerant, respectively, only gradually drips from the collector into the valve chamber. Accordingly, the supplied quantity of liquid is limited by the width of the opening in the intermediate bottom, thereby metered correspondingly.

The size of the oil passage opening in the intermediate bottom is chosen such that the oil mass flow setting caused by the pressure and flow conditions will equal about 1 to 5 percent of the gas mass flow. For the dimensions of usual vehicle air conditioning units, this ensures prevention of large quantities of liquid from continuing to flow at start conditions while at the same time ensuring sufficient oil to be supplied at normal drive conditions.

The volume of the valve chamber—considering the output of usual vehicle air conditioning units—should be only a few drops.

According to another advantageous embodiment of the invention, the valve is designed as a slotted diaphragm. The slotted diaphragm is a valve type that reacts to low forces, hence being suitable for low pressure differences, as useful in this case. In addition, the diaphragm is cost-effective, maintenance-free, and space-saving.

In another embodiment of the invention, the slotted diaphragm is connected to a rolling collar. The rolling collar everts at overpressure, thereby reducing the lateral pressure to the slots so that the slots open more readily. At closed condition, the rolling collar constrains the diaphragm with the slots, hence more heavily pressing the slot surfaces on each other so that they close more reliably.

According to another embodiment of the invention, a diaphragm is provided with a peripheral flexible bead so that a channel forms in the portion of the bead between the diaphragm and the bottom of the collector. In the annular channel, a passage opening ends through which the channel fills with liquid (refrigerant oil, liquid refrigerant). At an overpressure in the collector, the bead yields so that liquid can leave the channel, opening the valve. This design is realizable in a cost-effective, simple manner while the intermediate bottom can be dispensed with because metering is made possible by dimensioning the passage opening in the bottom of the collector.

According to another embodiment of the invention, the diaphragm is made of silicone. This material has shown to be especially durable and resistant to refrigerant oil (e.g. PAG) or refrigerant (e.g. R744), particularly in regards to maintaining flexibility.

In a further advantageous embodiment of the invention, the valve is a spring-loaded valve. Accordingly, the pressure difference at which the valve is to open can be predetermined by choosing a suitable closing spring. Because of the low pressure difference required, the design is particularly suitable for a small, possibly variable refrigerant flow such as at part load operation.

Another embodiment of the invention includes an elastically expandable diaphragm mounted below the bottom of the collector. A passage opening is made in the diaphragm. At a rest condition (without pressure difference), the diaphragm bears on a sealing surface disposed at the bottom of the collector. Therefore, the sealing surface closes the passage opening of the diaphragm. Below the diaphragm, a spring-loaded spring seating pan is disposed that presses the diaphragm upward. The passage opening passing the bottom of the collector is positioned out of the center of the diaphragm. Due to the overpressure in the collector, the diaphragm bulges downward in the moving portion on an accordingly wide area, thus generating greater forces which must overcome the pretension of the diaphragm and spring. As soon as the opening force overcomes these counter forces, the diaphragm moves downward, away from the sealing surface, thereby enabling flow through the passage opening. The design allows generating greater opening forces at smaller pressure differences.

Thus, the design offers the advantage that the pressure difference required to open the valve can be obtained precisely and stable for a long-term by correspondingly dimensioning, or choosing the spring and diaphragm. Also, the intermediate bottom can be dispensed with because metering is made possible by the passage openings.

In another embodiment of the invention, the valve is a bellows valve. The interior of the cylindrical bellows is hydraulically connected to the collector, and at overpressure, bulges spherically. Hence, the height of the bellows reduces so that the bellows lifts off the sealing surfaces arranged below, enabling flow. Functioning of the bellows is ensured by the hose-shaped bellows which include a fiber matrix disposed in longitudinal direction, but not expandable in longitudinal direction. Therefore, when the bellows is filled, it is expanded in a transverse direction and shortened in longitudinal direction. Advantageously, the bellows can be tensioned by a spring. Also, this design enables big opening forces to be generated at a small pressure difference.

In an alternative embodiment of the invention, the valve is a reed valve, or a flapper valve, which is cost-efficient and requires only little space.

In a further advantageous embodiment of the invention, the valve is actuated by a flow detector over a lever. In this way, the flow of the refrigerant gas can directly be used for controlling the valve when the refrigeration system is in operation.

According to another embodiment of this principle, the detector is a circular ring segment-shaped total-head flapper. Accordingly, the flow can easily be used for controlling the valve. The circular ring sector-shaped design of the total-head flapper is particularly suitable to be arranged between an outer and inner container wall after passage of the heat exchanger.

Advantageously, the valve opens in upward direction. This renders a simply supported lever usable between the detector and the valve. Further, at a closed state, a certain intrinsic safety is given, as at rest of the air conditioning unit the hydrostatic pressure of the liquid in the collector additionally presses the valve into the valve seat. Thus, when vibrations and bumps occur during operation of the vehicle, unintended opening of the valve is avoided.

According to another advantageous embodiment of the invention, an internal heat exchanger is combined with an accumulator. The internal heat exchanger is advantageously positioned above the outlet of the valve. The combination component makes special allowances to the important fact that in vehicle air conditioning units only little space is available. The oil, in this case, reflows into the circuit after overheating of the refrigerant in the heat exchanger. With the usual arrangement of the connections the heat exchanger outlet, like that of the collector sump together with the valve, is in the bottom portion of the accumulator. Therefore, no additional lines are necessary, which is advantageous in respect to a small size of the accumulator.

Due to the features according to the invention, a refrigerant accumulator with an internal heat exchanger can be produced at a lower cost. Space advantages arise from the enhanced ratio of useful volume to size of the accumulator with the internal heat exchanger, particularly for air conditioning units in vehicles. The invention makes possible to safely operate the compressor, as damage due to entry of liquid phase into the compressor is avoided. Also the efficiency of the air conditioning unit can be enhanced. The advantages listed result in cost benefits for combined accumulators with internal heat exchangers, as well as, for operating according air conditioning units.

It is particularly advantageous that control of the liquid supply to the low-pressure flow is ensured by the realization according to the invention, working independently without use of auxiliary energy and additional control effort.

DRAWINGS

Figure 2:
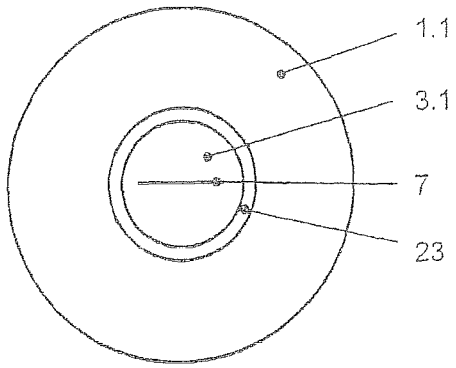
Figure 3:
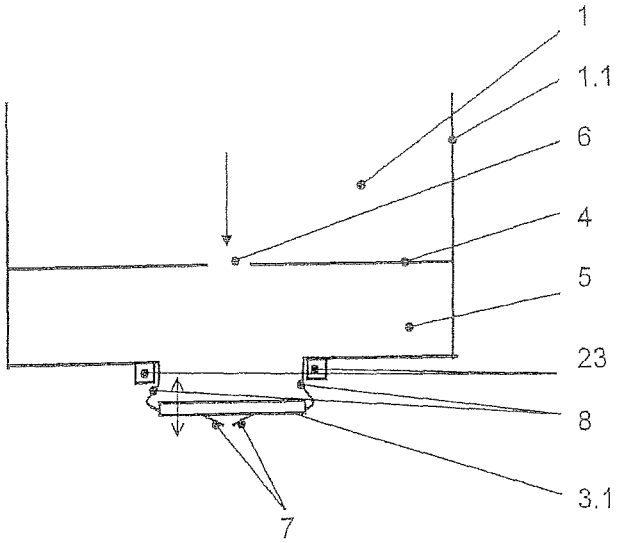
Figure 4:
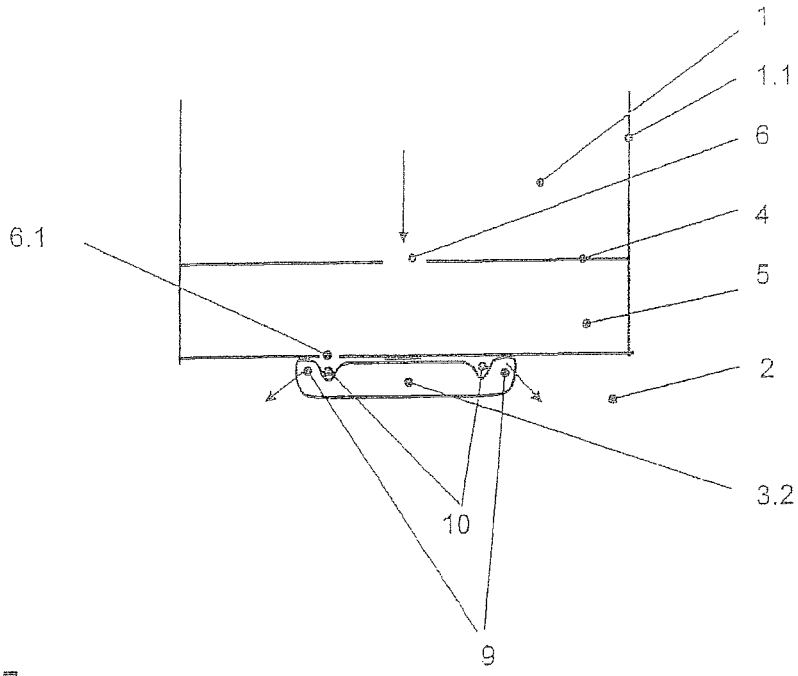
Figure 5:
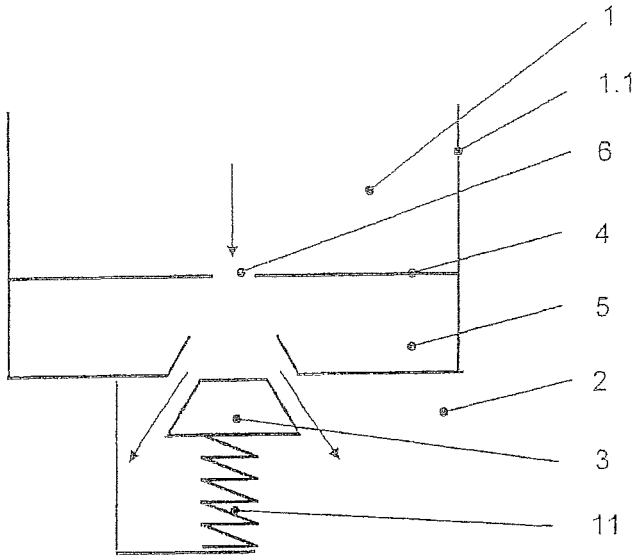
Figure 6:
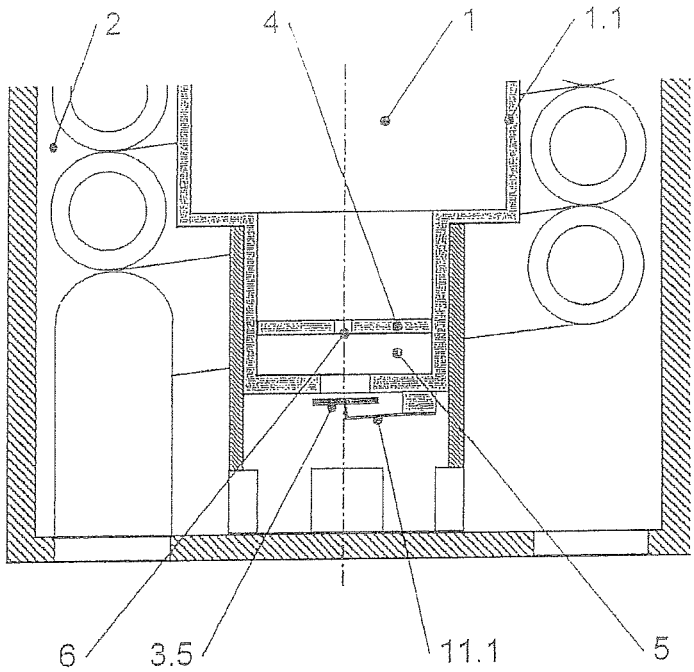
Figure 7:
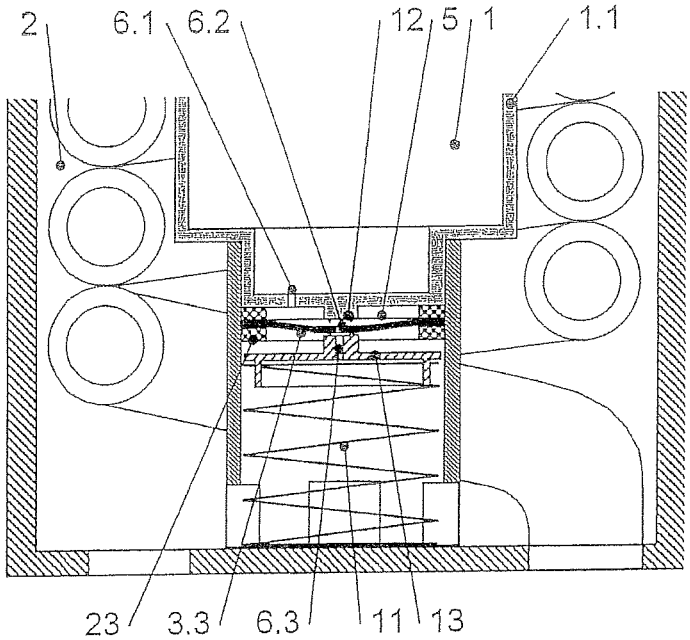
Figure 10:
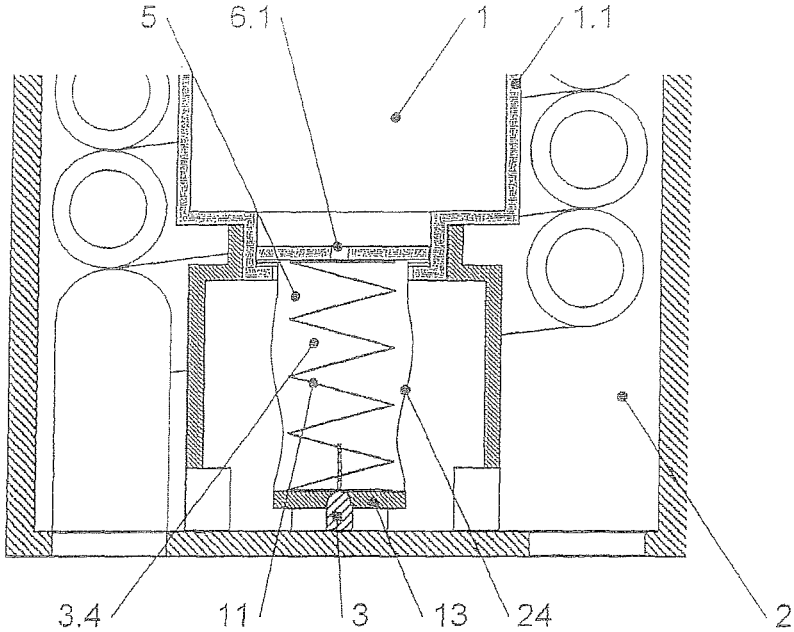
Figure 11:
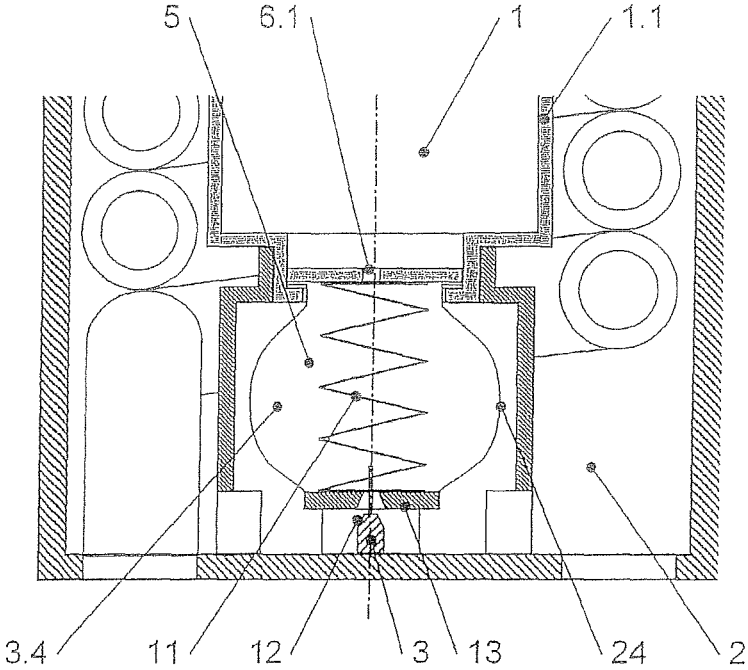

The above, as well as other advantages of the present disclosure, will become readily apparent to those skilled in the art from the following detailed description, particularly when considered in the light of the drawings described herein. The drawings show:

FIG. 1: a longitudinal section through an accumulator with integrated internal heat exchanger established with intermediate bottom;

FIG. 2: a valve design as slotted diaphragm in top view;

FIG. 3: a valve design as metering valve in longitudinal section;

FIG. 4: a valve design as sealing valve in longitudinal section;

FIG. 5: the detail of a valve with a closing spring in longitudinal section;

FIG. 6: the detail of a flapper valve with elastic suspension in longitudinal section;

FIG. 7: a diaphragm valve design with enlarged active surface in longitudinal section;

FIG. 8: a valve design with flow detector in longitudinal section;

FIG. 9: the top view of a valve with total-head flapper as cross-sectional view;

FIG. 10: the detail of a design with bellows valve in longitudinal section in closed state; and FIG. 11: the detail of a design with bellows valve in longitudinal section in opened state.

DETAILED DESCRIPTION OF THE INVENTION

The following description is merely exemplary in nature and is not intended to limit the present disclosure, application, or uses. It should also be understood that throughout the drawings, corresponding reference numerals indicate like or corresponding parts and features.

The refrigerant accumulator for vehicle air conditioning units with a collector and an adjoining flow chamber, particularly for vehicle air conditioning units, is realized as follows:

The embodiment is exemplarily described by a refrigerant accumulator with an integrated internal heat exchanger.

In FIG. 1, a longitudinal sectional view of an accumulator with an integrated internal heat exchanger 16 provided with an automatic valve 3 positioned at a bottom of the collector 1.1 is shown. Frequently, accumulators with internal heat exchangers 16 include two containers arranged concentric.

The inner container functions as collector/accumulator 1.1, enclosing a collector chamber 1. Between the wall of the collector 1.1 and the outer wall 17, in the lower portion, the heat exchanger 16 is disposed.

Tubes of the heat exchanger 16 are passed by a high-pressure side liquid refrigerant, whereby an inlet of a high-pressure part 18 is preferably positioned below. On an upper side, there is a high-pressure side outlet 19. An inlet of the low-pressure part 20 is also on the upper side. Gaseous refrigerant coming from an evaporator is first led into the collector 1.1. Also in the upper portion of the collector 1.1, an overflow opening 21 is disposed through which the refrigerant gas reaches the tube intermediate space of the heat exchanger 16. The place where the refrigerant gas leaves the heat exchanger 16 again is referred to as a flow chamber 2. Here, if required, a detector 15, see FIGS. 8 and 9, is disposed. In the collector chamber 1, an intermediate bottom 4 is inserted down below. Below the intermediate bottom 4, which is broken through by an opening 6, a valve chamber 5 is disposed. A valve 3 is positioned between the valve chamber 5 of the collector 1.1 and the flow chamber 2. An outlet of the low-pressure portion 22 is on the lower side of the outer container 17.

The collector 1.1 and the outer container 17 are, for example, made of suitable plastics or metals. The heat exchanger 16 is a coiled tube, positioned between the outer container 17 and the collector 1.1, functioning as internal heat exchanger in the component circuit.

The valve 3 is positioned in the region of the settling refrigerant oil at the bottom of the collector 1.1 and opens at an overpressure in the collector chamber 1 over the pressure in the flow chamber 2 (pressure difference). The overpressure in the collector chamber 1 can result when the refrigerant gas flows past the heat exchanger 16, causing friction losses which create a pressure loss in the flow chamber 2. The pressure difference at which the valve 3 opens is predeterminable through the dimensions of the valve, particularly of the surface effective in generating opening forces. In the collector chamber 1, the low-pressure side entry pressure governs. This pressure is higher than the pressure in the flow chamber 2. The pressure difference follows from the flow pressure loss during passage of the heat exchanger 16 and the hydrostatic pressure of the liquid column on the valve 3.

The response pressure of the refrigerant gas of the valve 3, therefore, must be slightly lower than the pressure difference between the collector 1.1 and the pressure at the outlet from the heat exchanger 16, or in the flow chamber 2, respectively. On the other hand, said pressure must be higher than the hydrostatic pressure of the liquid column containing refrigerant oil and liquid refrigerant, in order to prevent the liquid phase from flowing out when the compressor is at rest.

Above the valve 3, the intermediate bottom 4 with the oil passage opening 6 is positioned, separating the valve chamber 5 from the lower portion of the collector chamber 1. The valve chamber 5 should be dimensioned as small as possible, its dimensions only determined by the space requirements of the valve 3. As soon as the valve 3 opens, it ensures that not the total liquid volume of the collector chamber 1—both liquid refrigerant and refrigerant oil—flows therethrough, but only the liquid phase of the valve chamber 5. The volume of the valve chamber 5 limits the amount of liquid flowing to the flow chamber during the start of the compressor. The oil passage opening 6 in the intermediate bottom 4 takes over the metering function. The diameter of the opening 6 should be chosen for refrigerant accumulators such that about 1 to 5 mass percent oil, or liquid refrigerant, respectively, is added, or returned, respectively, to the gas mass flow. The oil passage opening 6 ensures that, particularly during the start of the air conditioning unit, liquid refrigerant or refrigerant oil from the collector chamber 1 only slowly flows, first, into the valve chamber 5 and then, through the valve 3 into the flow chamber 2. This measure prevents, during the starting, a large quantity of liquid from reducing the efficiency of the air conditioning unit or even damaging the compressor.

As an automatic valve 3, a diaphragm valve 3.1 is used in this embodiment as shown and explained in FIG. 2. An advantageous design of the diaphragm 3.1 is a two-fold slotted silicone disk.

FIG. 2 shows a valve design of the slotted diaphragm 3.1 in top view. The silicone diaphragm 3.1 provided with a slot 7, is, if necessary, held in a clamping and retaining frame 23, which is attached to the bottom of the collector 1.1, ensuring that in a non-operative condition the slot 7 is tightly closed.

A further embodiment of the diaphragm valve 3.1 of FIG. 2 is shown in FIG. 3. Here, the two-fold slotted silicone diaphragm 3.1 is connected over a peripheral, evertable rolling collar 8 to the bottom of the collector 1.1. At a closed condition, that is if there is no or a negative pressure difference, the pretension obtained during manufacture of the rolling collar 8 ensures that the rolling collar 8 re-everts. Re-everting ensures that the cut surfaces of the slot 7 are more strongly pressed on each other, causing the cut surfaces to be positioned between the clamping and retaining frame 23. Hence, the slots 7 close more reliably. The clamping and retaining frame 23 also serves to fasten the rolling collar 8 to the collector 1.1.

The overpressure first leads to everting of the rolling collar 8, so that the cut surfaces of the slot 7 no longer are pressed on each other, opening at a comparatively little pressure difference.

This valve design is known as a metering valve for packaging liquid food products.

Above the slotted diaphragm 3.1, the valve chamber 5 is separated from the collector chamber 1 by the intermediate bottom 4 with the opening 6.

Another embodiment is shown in FIG. 4. A diaphragm 3.2 is provided with a peripheral bead 9 and attached centrally to the bottom of the collector 1.1. The bead 9 together with the bottom of the collector 1.1 create an annular channel 10 where the oil passage opening 6.1 from the collector chamber 1, or valve chamber 5, respectively, ends. At an overpressure in the collector chamber 1, the pressure acts through the oil passage opening 6.1 and, at the same time, on the annular channel 10 so that the bead 9 accordingly yields due to its flexibility, enabling flow. If the overpressure is not sufficient, the bead 9 reattaches itself to the bottom of the collector 1.1, hence blocking the liquid flow. In this embodiment, the flexibility of the bead 9 is important. Therefore, the central portion can also be made of a stronger material or of an elastic material in a more compact design. Due to the larger area of the annular channel 10 compared with the oil passage opening 6.1, higher opening forces can be generated at the same pressure difference. The freely determinable size of the oil passage opening 6.1 allows that the intermediate bottom 4 with the opening 6 and the establishment of a valve chamber 5 can be dispensed with, or the peripheral channel 10 is the valve chamber 5.

The diaphragms 3.1, 3.2 can be preferably made of silicone. The elasticity and, hence, the overpressure at which the valve 3 opens, are predeterminable based on the thickness and the material properties. The overpressure in the collector chamber 1 results from the pressure difference due to the higher pressure loss through the flow chamber 2 with the heat exchanger not shown.

Now referring to FIG. 5, in an alternative design of the valve, a valve 3 loaded by a closing spring 11 is positioned at the bottom of the collector 1.1. The closing spring 11 arranges for the valve 3 to be pressed into the valve seat if there is no pressure difference. If, due to flow, a pressure difference exists, the closing spring 11 is compressed and the valve 3 enables the refrigerant oil to pass. Also, cone valves, ball valves, etc. are suitable valve types. Above the valve 3, the valve chamber 5 is separated from the collector chamber 1 by the intermediate bottom 4 with the opening 6.

In FIG. 6, the valve 3 is shown as a flapper valve or reed valve 3.5 connected to an elastic suspension 11.1. The elastic suspension causes a closing of the flapper valve 3.5, if there is a pressure difference between collector chamber 1 and flow chamber 2 below the hydrostatic pressure of the liquid phase in the collector chamber 1. As soon as the pressure difference rises accordingly, the flapper valve 3.5 opens. The closing force of the valve 3.5 results from the product of the spring constant of the elastic suspension 11.1 and the preloading distance. The product must correspond to a product of the area of the valve 3.5 and the pressure difference. An intermediate bottom 4 with the oil passage opening 6 separates the valve chamber 5 from the collector 1.1.

Another possible valve design is shown in FIG. 7. Here, an expandable diaphragm 3.3 is attached in a clamping and retaining frame 23 below the bottom of the collector 1.1. At its center, the diaphragm 3.3 is provided with an oil passage opening 6.2.

The diaphragm 3.3 at rest (without pressure difference) adjoins a sealing surface 12 positioned at the bottom of the collector 1.1. Thus, the sealing surface 12 closes the oil passage opening 6.2 made in the diaphragm 3.3. Below the diaphragm a spring pan 13 is positioned, loaded by a spring 11 and pressing the diaphragm 3.3 upward onto the sealing surface 12. The oil passage opening 6.1 passing the bottom of the collector 1.1 is outside the center of the diaphragm 3.3. Due to the higher pressure in the collector chamber 1 than that in the flow chamber 2, the diaphragm 3.3 in the moving range bulges downward over an accordingly wide area, thereby generating a greater opening force, which is counteracted by the pretension of the diaphragm 3.3 and the spring 11. As soon as the opening force overcomes these counteracting forces, the diaphragm 3.3 moves downward, hence separating from the sealing surface 12, and releasing the oil passage opening 6.2 through the diaphragm 3.3 and the adjacent spring pan 13. A guide not shown of the spring pan 13 is advantageous. The sealing surface 12 can also be established conical. This construction enables greater opening forces to be generated at a smaller pressure difference.

Also in the embodiment shown in FIG. 7, an additional intermediate bottom with passage to the separated portion of the valve chamber 5 can be dispensed with. Metering is realizable by dimensioning the oil passage openings 6.1, 6.2, 6.3, whereby the oil passage openings 6.2 and 6.3 are preferably aligned after each other. In this case, the valve chamber 5 is formed between the diaphragm 3.3 and the bottom of the collector 1.1.

In another version of the invention shown in FIG. 8, a valve 3 is connected to a lever 14. The valve 3 can be designed as a flapper valve or also as a ball or cone valve, arranged at the bottom of the collector 1.1. The lever 14 is, if necessary, moved by a flow detector 15 arranged at the outlet of the heat exchanger 16. Here, the detector 15 is established as a component that due to its shape puts up a resistance to flow. Therefore, the detector 15 is moved downward. If the rotation point of the lever 14, as shown, is positioned between detector 15 and valve 3, the valve 3 is moved upward and thus opened. Also, here, the opening pressure of the valve 3 can be pregiven by the ratio of the lever lengths and the areas of valve 3 and flow detector 15. Above the valve 3, the valve chamber 5 is separated from the collector chamber 1 by the intermediate bottom 4 with opening 6.

Here, it is advantageous that the actuation of the valve 3 is directly connected with detecting the flow.

Preferably, the flow detector 15 is established as a circular ring segment-shaped total-head flapper 15, shown in FIG. 9. In this way, the total-head flapper 15 is accordingly adapted to the annular space enclosed by the container walls of the collector and the outer container 17—the flow chamber 2 at the outlet from the heat exchanger 16. The total-head flapper 15 with lever system 14 actuates the valve 3. The total-head flapper 15 and the lever system 14 can, for example, be made of suitable plastics or of metals.

Another version of the solution is shown in FIGS. 10 and 11. Here, a bellows valve 3.4 serves to solve the problem of the invention.

FIG. 10 shows a closed condition of the bellows valve 3.4, and FIG. 11 shows the bellows valve 3.4 at an opened condition. The bellows valve 3.4 comprises a bellows 24, spanned by a spring 11 between the bottom of the collector 1.1 and the spring pan 13. The bellows valve 3.4 is not elastic in a longitudinal direction. In the closed case, shown in FIG. 10, the interior of the bellows 24—that is also the valve chamber 5—is loaded with equal pressure as the collector chamber 1. Also integrated into the spring pan 13 is the valve seat, which presses against a valve cone 3, for example, fixed at the bottom of the flow chamber 2. Hence, preventing a flow therethrough. If now, as shown in FIG. 11, due to the refrigerant flow in the flow chamber 2 a positive pressure difference (overpressure) governs in the collector chamber 1, the bellows 24 expands, tending to enlarge its volume by ballooning. This results because of the non-existing longitudinal elasticity of the bellows 24. The distance between the bottom of the collector 1.1 and the spring pan 13 decreases. So, the spring pan 13 with the valve seat lifts off the valve cone 3. Thus, the bellows valve 3.4 opens releasing flow.

As soon as flow stops in the flow chamber, the pressure in the collector chamber 1 and flow chamber 2 balances and the bellows 24 re-contracts, as shown FIG. 10. Hence, the spring pan 13, supported by the force of the spring 11, moves toward the valve cone 3 and the bellows valve 3.4 closes.

Greater opening forces can be generated at a low pressure difference due to the size of the bellows 24. Selection and pretension of the spring 11 enables the opening pressure difference of the bellows valve 3.4 to be dimensioned.

Also in this solution, an intermediate bottom can be dispensed with. Generally, the arrangement of the collector chamber 1 and the flow chamber 2 can of course be different from that in the above mentioned examples of the embodiment.

The chambers 1, 2 can also be positioned side by side. Also, it is not necessary that there is a heat exchanger 16 above the flow chamber 2 or at another place. Finally, the flow chamber 2 can also be, for example, a small tube. Also, the flow chamber 2 and the collector chamber 1 need not be combined into one component.

Also, the application need not be limited to air conditioning, refrigeration and heat pump systems, but can include all arrangements where a valve opens for the purpose of feeding another or same substance or material upon a flow or a pressure difference of a liquid or gaseous substance, or flow of a flowable solid material.

While certain representative embodiments and details have been shown for purposes of illustrating the invention, it will be apparent to those skilled in the art that various changes may be made without departing from the scope of the disclosure, which is further described in the following appended claims.

NOMENCLATURE

1 collector chamber
1.1 collector, accumulator
2 flow chamber
3 valve, valve cone
3.1 slotted diaphragm, diaphragm valve, silicone diaphragm
3.2 diaphragm with peripheral bead
3.3 diaphragm with oil passage opening
3.4 bellows valve
3.5 reed/flapper valve, valve flapper
4 intermediate bottom
5 valve chamber
6 opening, oil passage opening in the intermediate bottom
6.1 opening, oil passage opening in the bottom of the collector chamber (1) or valve chamber (5), respectively
6.2 opening, oil passage opening in the diaphragm
6.3 opening, oil passage opening in the spring pan
7 slot
8 rolling collar
9 elastic bead
10 annular channel
11 closing spring, spring
11.1 elastic suspension
12 sealing surface
13 spring pan
14 lever (system)
15 detector, flow detector, total-head flapper
16 heat exchanger
17 outer wall, outer container
18 inlet high-pressure part
19 high-pressure side outlet
20 inlet low-pressure part
21 overflow opening (low-pressure part)
22 outlet low-pressure part
23 clamping and retaining frame
24 bellows

What is claimed is:

1. A refrigerant accumulator comprising:

a container having a wall defining a flow chamber therein, the flow chamber having a refrigerant gas disposed therein;

a collector disposed in the flow chamber of the container, the collector defining a collector chamber therein and a valve chamber below the collector chamber, wherein the collector chamber collects a liquid therein, the liquid containing at least one of a refrigerant oil and a liquid refrigerant, and wherein the collector chamber includes an intermediate bottom separating the valve chamber from the collector chamber for accepting a flow of the liquid, the collector chamber including a wide upper portion and a narrow lower portion, and wherein an outer diameter of the wide upper portion is larger than an outer diameter of the narrow lower portion;

a heat exchanger disposed between the collector and the wall of the container, wherein the heat exchanger spirally surrounds the narrow lower portion of the collector chamber; and a valve disposed between the valve chamber and the flow chamber, wherein the valve is disposed in an opening formed in a bottom of the collector to selectively control the flow of the liquid from the valve chamber to the flow chamber, and wherein the intermediate bottom includes an oil passage opening formed therein, and the oil passage opening is configured to limit a quantity of the liquid supplied to the valve chamber.

2. The refrigerant accumulator according to claim 1, wherein the oil passage opening formed in the intermediate bottom has a diameter dimensioned to permit about one to five mass percent of the liquid to return to a mass flow of the refrigerant gas.

3. The refrigerant accumulator according to claim 1, wherein the valve is a diaphragm.

4. The refrigerant accumulator according to claim 3, wherein the diaphragm is produced from an elastic material.

5. The refrigerant accumulator according to claim 3, wherein the diaphragm is produced from silicone.

6. The refrigerant accumulator according to claim 3, wherein the diaphragm includes at least one slot formed therein.

7. The refrigerant accumulator according to claim 6, wherein the diaphragm is connected to a bottom of the collector chamber over a peripheral rolling collar, whereby the rolling collar is pretensioned such that without pressure the slots are positioned between the rolling collar, and at an overpressure in the collector chamber the rolling collar bulges and the at least one slot formed in the diaphragm opens.

8. The refrigerant accumulator according to claim 3, wherein the diaphragm is fixed at a center thereof to a bottom of the collector chamber and includes a peripheral bead, the peripheral bead together with the bottom of the collector chamber form an annular channel at which an oil passage opening of at least one of the collector chamber and a valve chamber ends.

9. The refrigerant accumulator according to claim 1, wherein the valve is coupled to the collector by a clamping and retaining frame.

10. The refrigerant accumulator according to claim 1, wherein the heat exchanger is disposed in a space defined between the narrow lower portion of the collector chamber and the wall of the container.

* * * * *